US007743545B1

(12) United States Patent
Moody et al.

(10) Patent No.: US 7,743,545 B1
(45) Date of Patent: Jun. 29, 2010

(54) VERTICAL FOREGRIP LEG EXTENDER

(75) Inventors: Joseph R. Moody, Jacksonville, FL (US); Joseph D Gaddini, Ashville, NC (US)

(73) Assignee: Grip Pod Systems, LLC, Jacksonville, FL (US)

( * ) Notice: Subject to any disclaimer, the term of this patent is extended or adjusted under 35 U.S.C. 154(b) by 137 days.

(21) Appl. No.: 11/937,704

(22) Filed: Nov. 9, 2007

Related U.S. Application Data

(63) Continuation-in-part of application No. 11/485,762, filed on Jul. 13, 2006, now Pat. No. 7,490,429, which is a continuation-in-part of application No. 29/259,347, filed on May 5, 2006, which is a continuation-in-part of application No. 10/725,082, filed on Dec. 2, 2003, now Pat. No. 7,111,424.

(60) Provisional application No. 60/899,066, filed on Feb. 2, 2007.

(51) Int. Cl.
*F41C 23/16* (2006.01)

(52) U.S. Cl. ..... 42/94; 42/72; 248/161

(58) Field of Classification Search ..... 42/94, 42/72, 85, 27; 89/37.04, 37.03, 40.06; 248/171, 248/188, 188.2, 188.5, 161
See application file for complete search history.

(56) References Cited

U.S. PATENT DOCUMENTS

| | | | |
|---|---|---|---|
| 271,251 | A | 1/1883 | Leerbech et al. |
| 579,529 | A | 1/1897 | Stephens |
| 721,425 | A | 2/1903 | Clyde |
| 1,295,688 | A | 2/1919 | Butler |
| 1,355,660 | A | 10/1920 | Farquhar et al. |
| 1,382,409 | A | 6/1921 | Butler |
| 1,580,406 | A | 4/1926 | Browning |
| 2,386,802 | A | 10/1945 | Johnson |
| 2,420,267 | A | 5/1947 | Sefried |
| 2,436,349 | A | 2/1948 | Adams |
| 2,489,283 | A | 11/1949 | Garand |
| 2,763,456 | A | 9/1956 | Breer |

(Continued)

FOREIGN PATENT DOCUMENTS

EP 0127193 * 11/1980

(Continued)

OTHER PUBLICATIONS

Denis H.R. Archer, M.A., Jane's Infantry Weapons, (1976) pp. 1-3.

(Continued)

*Primary Examiner*—Benjamin P Lee
(74) *Attorney, Agent, or Firm*—Brian S. Steinberger; Law Offices of Brian S. Steinberger, P.A.

(57) ABSTRACT

Devices, and methods of extending legs from vertical fore grip handles on firearms, such as rifles, to different height positions. The vertical fore grip can include expandable bipod legs. The legs can be individually extended to different lengths by moving telescoping rod members in leg housings from retracted positions to extended positions. A lever switch can allow for the legs to be locked into the different extended positions, and depressing the switch can allow for the legs to go back to the retracted positions. Anti-rotation pins and slots can prevent the telescoping members from rotating relative to the legs.

21 Claims, 5 Drawing Sheets

U.S. PATENT DOCUMENTS

| | | | | |
|---|---|---|---|---|
| 3,235,997 | A | 2/1966 | Stoner | |
| 3,632,073 | A | 1/1972 | Nakatani | |
| 4,121,799 | A | 10/1978 | Michio | |
| 4,351,224 | A * | 9/1982 | Curtis | 89/37.04 |
| 4,545,660 | A | 10/1985 | Rudolf | |
| 5,345,706 | A | 9/1994 | Brown | |
| 5,384,609 | A | 1/1995 | Ogawa et al. | |
| 5,438,786 | A | 8/1995 | Hilderbrand | |
| 5,711,103 | A * | 1/1998 | Keng | 42/94 |
| 5,815,974 | A * | 10/1998 | Keng | 42/94 |
| 6,289,622 | B1 | 9/2001 | Desch, Jr. et al. | |
| 6,487,807 | B1 | 12/2002 | Kopman et al. | |
| 6,763,627 | B1 * | 7/2004 | Kaempe | 42/94 |
| 6,829,857 | B1 * | 12/2004 | Houtsma | 42/94 |
| 7,032,494 | B2 * | 4/2006 | Wygant | 89/37.04 |
| 7,409,791 | B2 * | 8/2008 | Moody et al. | 42/72 |
| 7,412,793 | B2 * | 8/2008 | Moody et al. | 42/72 |
| 7,421,815 | B1 * | 9/2008 | Moody et al. | 42/72 |
| 7,478,496 | B2 * | 1/2009 | Bender | 42/94 |
| 7,490,429 | B2 * | 2/2009 | Moody et al. | 42/72 |
| 2005/0241206 | A1 | 11/2005 | Teetzel et al. | |
| 2005/0242250 | A1 * | 11/2005 | Keng et al. | 248/168 |
| 2008/0052979 | A1 * | 3/2008 | Lee et al. | 42/94 |
| 2008/0307689 | A1 * | 12/2008 | Dotson | 42/94 |
| 2009/0038200 | A1 * | 2/2009 | Keng | 42/94 |
| 2009/0045304 | A1 * | 2/2009 | Faifer | 248/188.5 |
| 2009/0126250 | A1 * | 5/2009 | Keng | 42/94 |

FOREIGN PATENT DOCUMENTS

| | | | |
|---|---|---|---|
| EP | 0127193 | A1 * | 6/1984 |

OTHER PUBLICATIONS

Brugger & Thomet Unipod, Forward grip with retractable bipod, [online] DSA Inc. Systems Second to None, DSA Order Center, 1 page, [Retrieved on Oct. 18, 2006] Retrieved from: http://www.dsarms.com/item-detail.cfm?ID=BT21830A&storeid=1&image=bt21830A.gif.

* cited by examiner

VERTICAL FOREGRIP LEG EXTENDER

This invention claims the benefit of priority to U.S. Provisional Patent Application No. 60/899,066 filed Feb. 2, 2007 and this invention is a continuation in part of U.S. patent application Ser. No. 11/485,762 filed Jul. 13, 2006, which is a continuation in part of U.S. patent application. Ser. No. 10/725,082 filled Dec. 2, 2003, now U.S. Pat. No. 7,111,424, and U.S. Design patent application Ser. No. 29/259,347 filed May 5, 2006.

FIELD OF THE INVENTION

The present invention relates to firearms and more particularly to devices, apparatus, systems and methods of allowing a firearm, such as a rifle, to be supported by a fore grip/gun handle having bipod type legs, wherein the legs individually or in combination can adjustably extend outward to different heights so that the firearm can be supported over uneven surfaces.

BACKGROUND AND PRIOR ART

Bipod stands have been popular over the years, and generally include two legs that extend outward in a triangular configuration beneath a weapon, such as rifle. For example, the known prior art includes but is not limited to U.S. Pat. Nos. 271,251; 1,295,688; 1,355,660; 1,382,409; 1,580,406; 2,386,802; 2,420,267; 2,436,349, and 3,235,997. These patents disclose the respective art in relation to bipods, but do not disclose bipod stands having adjustable length legs. In addition, the bipod legs are generally fixed and cannot collapse back into a forward vertical grip.

U.S. Pat. No. 6,487,807 describes a tripod gun handle that provides a combination pistol grip and pivotal tripod. An examination of this patent reveals a number of problems with this device, and the most obvious problem is that the tripod legs are positioned on the exterior of the handle when not deployed. If the gun with this device attached was being used in wet or muddy environments, either in a deployed or storage position, the ingress of mud and dirt into and around the handle could result in the deployment and storage of the tripod legs being severely restricted due to the mud or foreign matter. Another problem is that deployment requires the rotation of a disengagement cam to force the legs into their deployed position and then a leg locking to assembly is rotated to lock the legs into a locked position. Two separate actions are required to deploy and lock the tripod legs into a locked position.

A problem with these bipods and leg stands is that the legs on the stands are generally locked in fixed positions, where an operator would have to physically move the entire stand to adjust the position of the firearm supported on the stand. For example, an operator would have to physically move and raise the stand to adjust firearm to fire a shot. Such physical movements of having to physically move or tilt the stand can result in lost time to take a shot. Also, constantly raising, lowering and tilting the firearm would be naturally uncomfortable to the operator.

Tilting or raising the firearm to a non fully supported position can cause the firearm to be forced to be held in an unsteady position where it is difficult and potentially impossible to be able to fire a reliable shot at an intended target.

Another problem with traditional stands such as bipods and tripods for firearms with fixed leg lengths is that the firearm is often to be used in the field and require placements of the stands on uneven terrains such as rocky surfaces, hills, and the like. Here, the uneven surfaces can cause the supported firearm to not be level. The unleveled firearms can result in difficult and impossible shots to be fired.

The inventors of the subject invention have to date patented at least one U.S. Pat. No. 7,111,424 to Gaddini. This patent includes a replaceable mounting assembly that allows for mounting of the gun handle by various means to a gun. A fore grip or gun handle, designed with ergonomic reasons in mind, provides a stable means of holding the gun. A plurality of legs that are concealed within the fore grip are coupled via a hinge to a spring piston assembly. A spring-loaded fulcrum release mechanism holds the piston assembly in a compressed and locked position. When the piston assembly is released upon activation of the spring-loaded fulcrum release mechanism, the legs are driven downwards by the piston and upon being released from the confinement of the fore grip are deployed outwards to a locked position by a hinge or pivot mechanism. The legs have feet that are designed so that, when the legs are concealed within the handle, the feet seal off the deployment and spreader mechanisms from entrance of any debris, material etc that may interfere with the deployment of the bipod. However, the bipod legs extend out into a fixed bipod orientation, where the legs also cannot be adjustably lengthened.

Thus, the need exists for solutions to the problems addressed above.

SUMMARY OF THE INVENTION

A primary objective of the subject invention is to provide a firearm fore grip/gun handle with extendable legs thereon allowing the firearm to stand on uneven surfaces.

A secondary objective of the subject invention is to provide a firearm fore grip/gun handle having telescopic legs allowing the firearm to be on uneven surfaces.

A third objective of the subject invention is to provide a firearm fore grip/gun handle having individually extendable legs that can individually length adjusted.

A fourth objective of the subject invention is to provide a firearm fore grip/gun handle having legs that can be height adjusted to support the firearm in stable positions on uneven terrains.

A fifth objective of the subject invention is to provide a firearm fore grip/gun handle height adjustable bipod legs for support on different surfaces.

A sixth objective of the subject invention is to provide a firearm fore grip/gun handle having height adjustable legs for customizing the tilt orientation of the firearm, wherein the firearm can adjustably tilt to the right or tilt to the left.

A preferred embodiment of the invention can have telescoping extendable legs that can be individually extended from beneath the fore grip handle.

The invention can be used with fore grips having concealable and collapsible bipod legs. Alternatively, the accessory mount can be used with other types of fore grips.

A firearm fore grip with accessory mount holder, can include an elongated handle having a top end and a bottom end and outer sidewalls between the top end and the bottom end, and an accessory mount having a portion that is attached to a portion of the outer sidewalls of the handle, the accessory mount having rails for allowing an accessory to be removably attached to the rails on the accessory mount.

The accessory mount can be molded to a side portion of the outer sidewalls of the handle.

A preferred embodiment of the firearm fore grip with extendable legs, can include an elongated handle having a top end and a bottom end, the top end being attached to a firearm, and legs beneath the handle, each of which can be extended to different height positions. The legs can be bipod legs. The legs can each have elongated rod members within the legs having different extendable positions.

Each of legs can have an access slot for allowing a user to grip a portion of the elongated rod members in order to extend the legs to the different extendable positions.

The elongated members can have stepped grooves along an outer side. A depressible lever can catch into selected step groove(s) and be used for locking the elongated rod members in the different extendable positions.

The embodiment can have pins extending from the rod members through the to longitudinal slots in the legs for preventing the rod members from rotating relative to the legs. The rod members can have the longitudinal slots and the main legs can have pins that extend into the slots and also be used for preventing the rod members from rotating relative to the legs.

The rod members can include angled foot portions which fit within angled foot portions on each of the legs.

A novel method of extending heights of each respective leg of bipod legs that support firearms, can include the steps of providing a firearm with a bipod stand having two main legs which are positioned at a triangle orientation beneath the firearm, pulling an inner leg portion from at least one of the two legs so that a bottom of the inner leg extends outward beneath an outer bottom portion of the main leg, and locking the inner leg to a selected height extended position relative to the main leg.

The method can include the step of depressing a spring biased latch so that inner leg can ratchet downward to a selected step edge row from a plurality step rows.

The method can include the step of preventing the inner leg from rotating relative to the main leg while the inner leg is being pulled to extend outward beneath the outer bottom of the main leg. The preventing step can further include a pin extending from the inner leg through a longitudinal slot in the main leg so that the inner leg is prevented from rotating relative to the main leg.

Further objects and advantages of this invention will be apparent from the following detailed description of a presently preferred embodiment, which is illustrated in the accompanying flow charts and drawings.

BRIEF DESCRIPTION OF THE FIGURES

Referring particularly to the drawings for the purposes of illustration only, and not limitation.

DESCRIPTION OF THE PREFERRED EMBODIMENT

Figures 1, 2, 3:
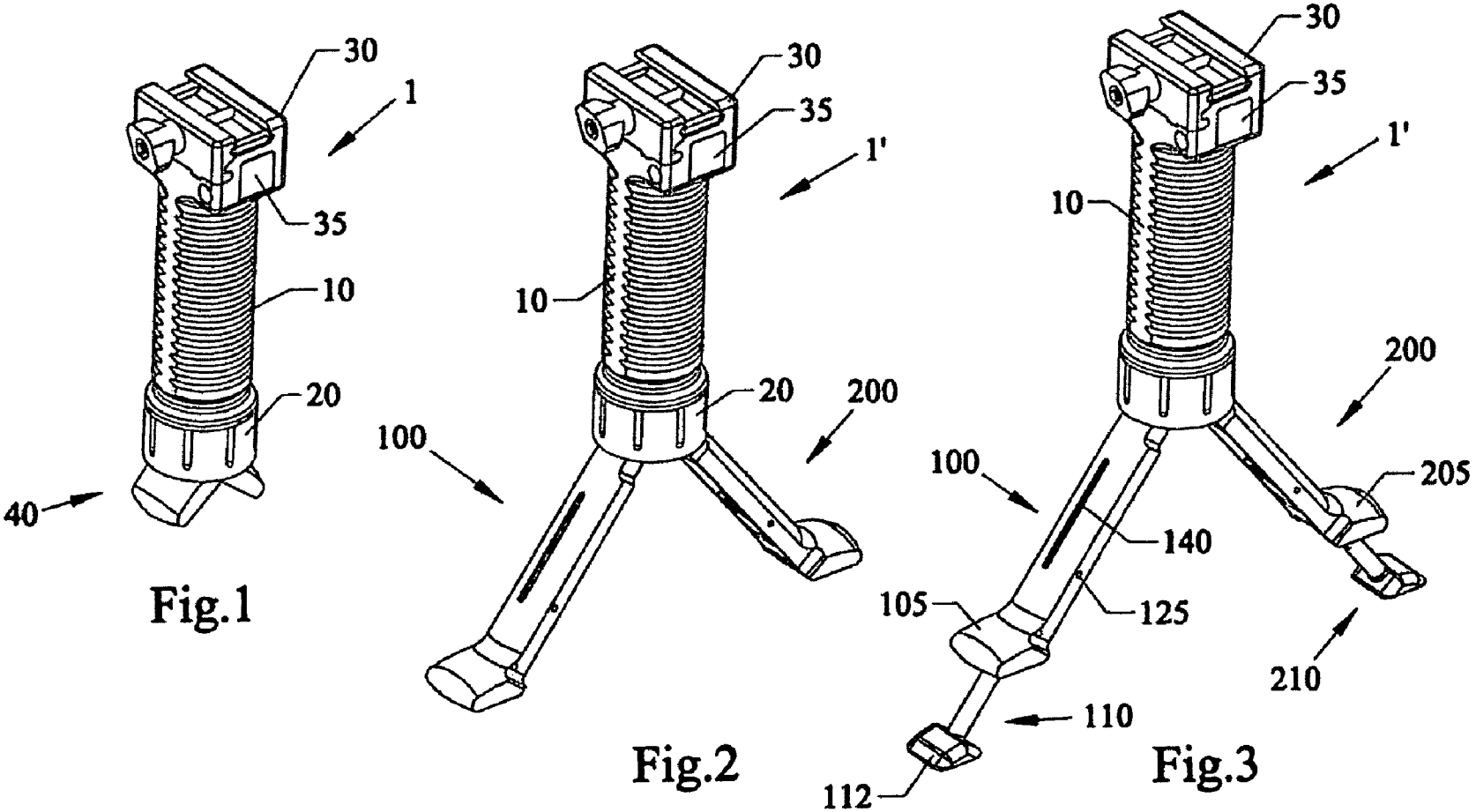
FIG. 1 is an upper perspective view of a bipod fore grip with concealable legs.
FIG. 2 is another view of novel fore grip of FIG. 1 with modified novel legs in an expanded position.
FIG. 3 is another view of the fore grip of FIG. 2 with the expanded legs further extended.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

A listing of components will now be described.

1. Bipod Fore Grip With Extendable Legs
1'. Novel Fore Grip with Further extendable legs
10. main handle portion of fore grip
20 lower end (screwable cap) portion or fore grip
30 upper head end portion of fore grip
35 depressible button to actuate/deploy extendable legs
40 existing bipod legs
100 novel left single leg of fore grip
105 novel left foot
110 novel inner separately extendable leg for left leg
112 bottom angled foot
114 rows of step grooves for height adjustments
116 anti-rotation horizontal pin
118 upper end of inner leg
120 depressible and pivotable latch button
122 roughened/raised edge surface tab
125 pivot pin mid-portion
128 bottom catch edge
130 spring piston latch stop
140 longitudinal slot in front wall (anti-rotate slot)
150 optional extension/retraction spring
160 left leg finger access slot
200 novel right single leg of fore grip
205 novel right foot
210. novel inner separately extendable leg for right leg
212 bottom angled foot
240 right leg latch button
250 optional extension/retraction spring
260 right leg finger access slot
300 firearm with picatinny rails The invention is a continuation in part of U.S. patent application Ser. No. 11/485,762 filed Jul. 13, 2006, which is a continuation in part of U.S. patent application Ser. No. 10/725,082 filed Dec. 2, 2003, now U.S. Pat. No. 7,111,424, and U.S. Design patent application Ser. No. 29/259,347 filed May 5, 2006, all by similar inventors and assigned to the same assignee, which are all incorporated by reference.

As shown in the figures, the invention can be used with the assignees novel bipod fore grip 1 that has a mounting section or end 30 having parallel rails that can be attached to rails, such as Picatinny rails on a firearm such as a rifle (see FIG. 16), and the like, by adjusting the head piece clamps with rail clamp bolt. The bipod fore grip 1 can include of a machining or a casting that utilizes aluminum or a molding that utilizes high impact resistant polymer or a composite material. The bipod fore grip is a grip for gripping by the hand of a user when the fore grip is attached to the firearm.

Although the mounting end 30 is shown as being an integral part of the handle 10 for illustration purposes only, it should be understood that the mounting end head piece can be a separate component that is then attached by other members, such as threads or a lock screw or locking bolt to the handle. For illustrative purposes, the mounting end head piece 30 uses a Picatinny mounting rail (MIL-STD-1913 rail), a mounting system widely used by military for attachment of various devices to military rifles. However, it should be understood that other methods of attachment to a firearm could be used.

As described in the parent patent applications that are incorporated by reference, FIG. 1 is an upper perspective view of a bipod fore grip 1 with concealable legs 40. The fore grip 1 can have a handle portion 10, with bottom retaining cap 20 that can have concealable and collapsible bipod legs 40. One version can have a tubular recess consisting of a first cylindrical cutout housing the bipod legs when concealed and a sliding piston that deploys the legs and a second cylindrical cutout housing a release mechanism and a void space for other accessories.

The release mechanism such as a depressible button 35 can have a compression spring positioned between the piston assembly and the bottom of the first cylindrical cutout and the compression spring. The legs 40 are connected to the bottom of the piston assembly via a hinge and spring that when released from confinement within the fore grip, causes the legs to expand outward until deployed.

Another version of the fore grip 1 with, bipod legs 40 of FIG. 1 uses only one spring, wherein the legs can be gravity and/or snap/shook released from the handle by a switch (such as the depressible button) and the spring expands the legs out to the fully deployed position.

To use the fore grip 1 of FIG. 1, a user simply attaches the fore grip to the firearm, regardless of whether or not the bipod legs 40 are deployed. If the legs 40 are deployed, then the user has the option of using the gun with the legs deployed or compressing or squeezing the legs together, and pushing them upwards into the fore grip until the male part of the spring-loaded fulcrum release mechanism catches and locks the bipod legs and the piston assembly into the closed position.

As described above, the invention can be used with the inventors' novel bipod fore grip 1 shown in the FIG. 1. A preferred embodiment of the bipod fore grip can have the head piece 30 with a length of approximately 1.85 inches a width of approximately 1.29 inches and a height of approximately 1.15 inches. In a fully leg retracted/closed position, the fore grip 1 can have a height of approximately 6.32 inches. The handle portion 10 can have a length of approximately 2.95 inches and a width of approximately 1.37 inches. The legs 40 can have a width of approximately 0.73 inches along with the feet having a width of approximately 0.99 inches. In a fully deployed/expanded position, the fore grip 1 can have an overall height of approximately 8.57 inches, with the legs 120 having a spread eagle angle therebetween of approximately 76 degrees, and the inside angle of the feet 128 to the rest of the legs being approximately 52 degrees. The feet can be spread apart from toe to toe at approximately 6.95 inches.

Although, the preferred embodiment lists specific dimensions, the invention can be practiced with different sized and shaped components.

The fore grip 1 can be made from various components such as but not limited to polymeric materials, such as but not limited, to plastic and/or glass filled nylon with and without metal inserts such as aluminum, galvanized metal, stainless steel, and the like Additionally, the fore grip can include void spaces where possible to decrease weight.

Although a depressible button 35 is shown above, the invention can use other types of activation such as but not limited to toggle switches, pressure actuated switches, temperature actuated switches and the like, to release the inside legs to slide down and expand outward from beneath the housing.

Figure 5:
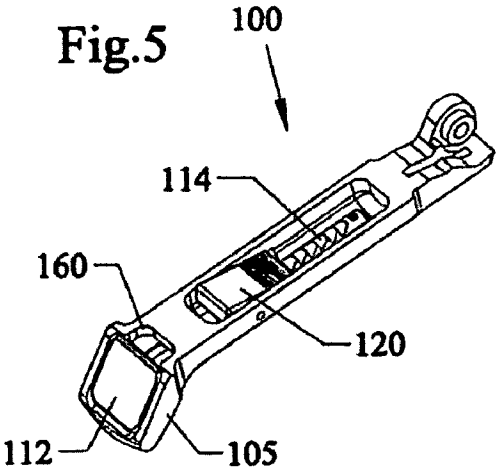
FIG. 5 is another perspective view of the leg of FIG. 4 with the latch button depressed.
Figure 7:
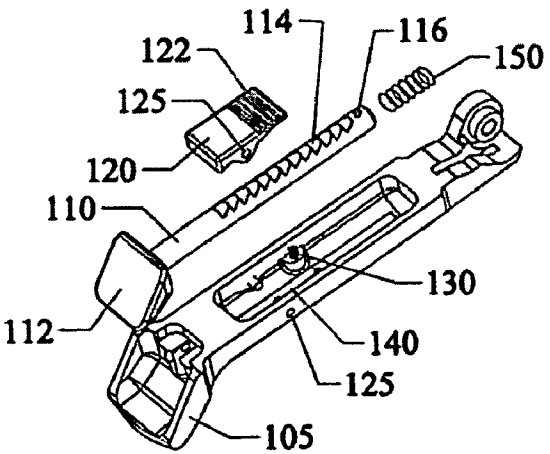
FIG. 7 is an exploded perspective view of the extendable leg of FIGS. 4-6.
Figure 4:
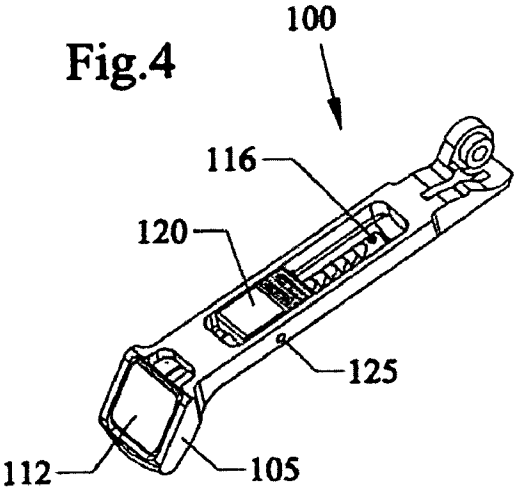
FIG. 4 is a rear perspective view of a single leg of the fore grip of the preceding figures.
Figure 6:
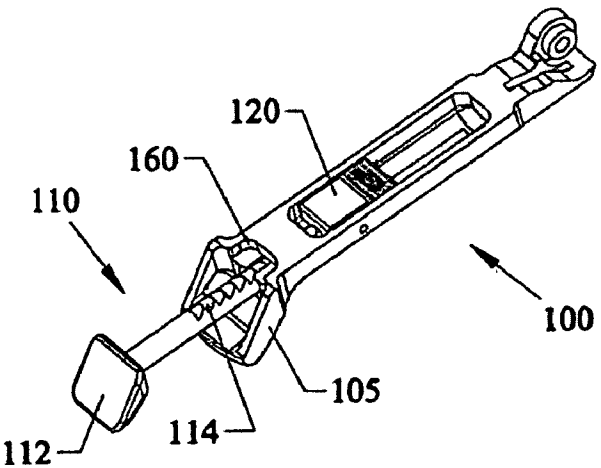
FIG. 6 is another perspective view of the leg of FIG. 4 further extended.

FIG. 2 is another view of a novel fore grip 1' of FIG. 1 with modified novel legs 100, 200 in an expanded position. FIG. 3 is another view of the fore grip 1' of FIG. 2 with the inner legs 110, 210 of the expanded legs 100, 200 further extended. FIG. 4 is a rear perspective view of a single leg 100 of the fore grip of the preceding figures. FIG. 5 is another perspective view of the leg 100 of FIG. 4 with the latch button depressed. FIG. 6 is another perspective view of the inner leg 110 of FIG. 4 further extended. FIG. 7 is an exploded perspective view of the extendable inner leg 110 of FIGS. 4-6.

Figure 9:
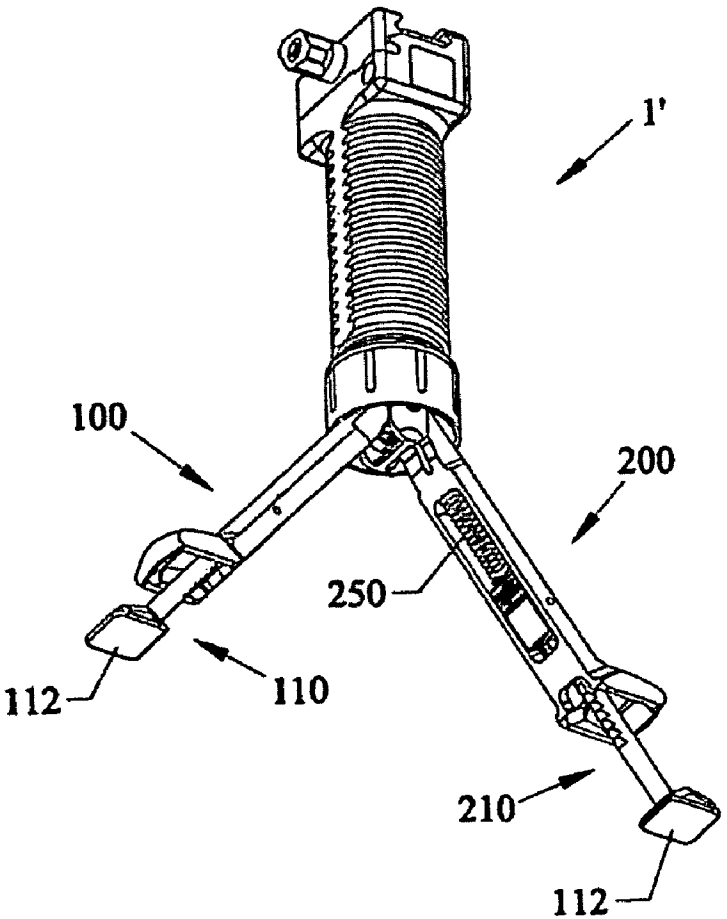
FIG. 9 is another, view of the fore grip of FIG. 8 with both legs further extended.
Figure 8:
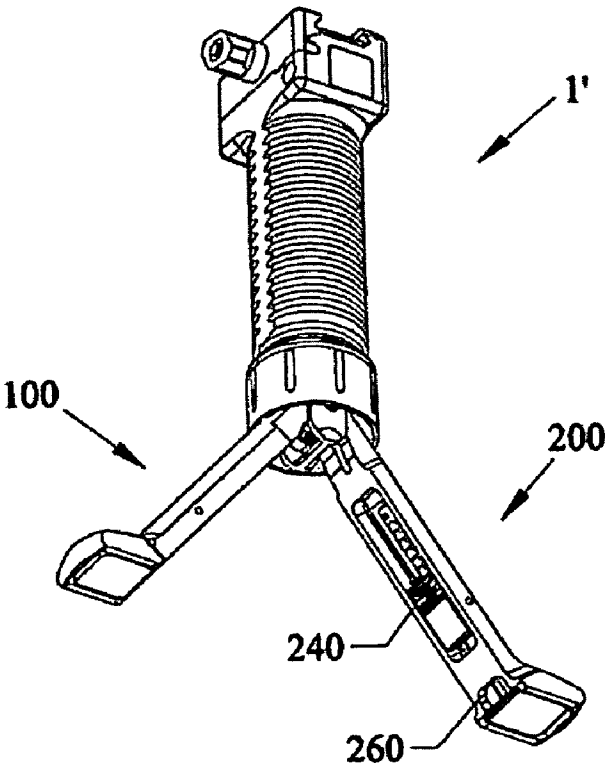
FIG. 8 is a lower perspective view of the bipod fore grip of FIG. 2 with expanded legs.

FIG. 8 is a lower perspective view of the bipod fore grip 1' of FIG. 2 with expanded legs 100. FIG. 9 is another view of the fore grip of FIG. 8 with both inner legs 110, 210 further extended.

Figures 10, 11, 12, 13, 14, 15:
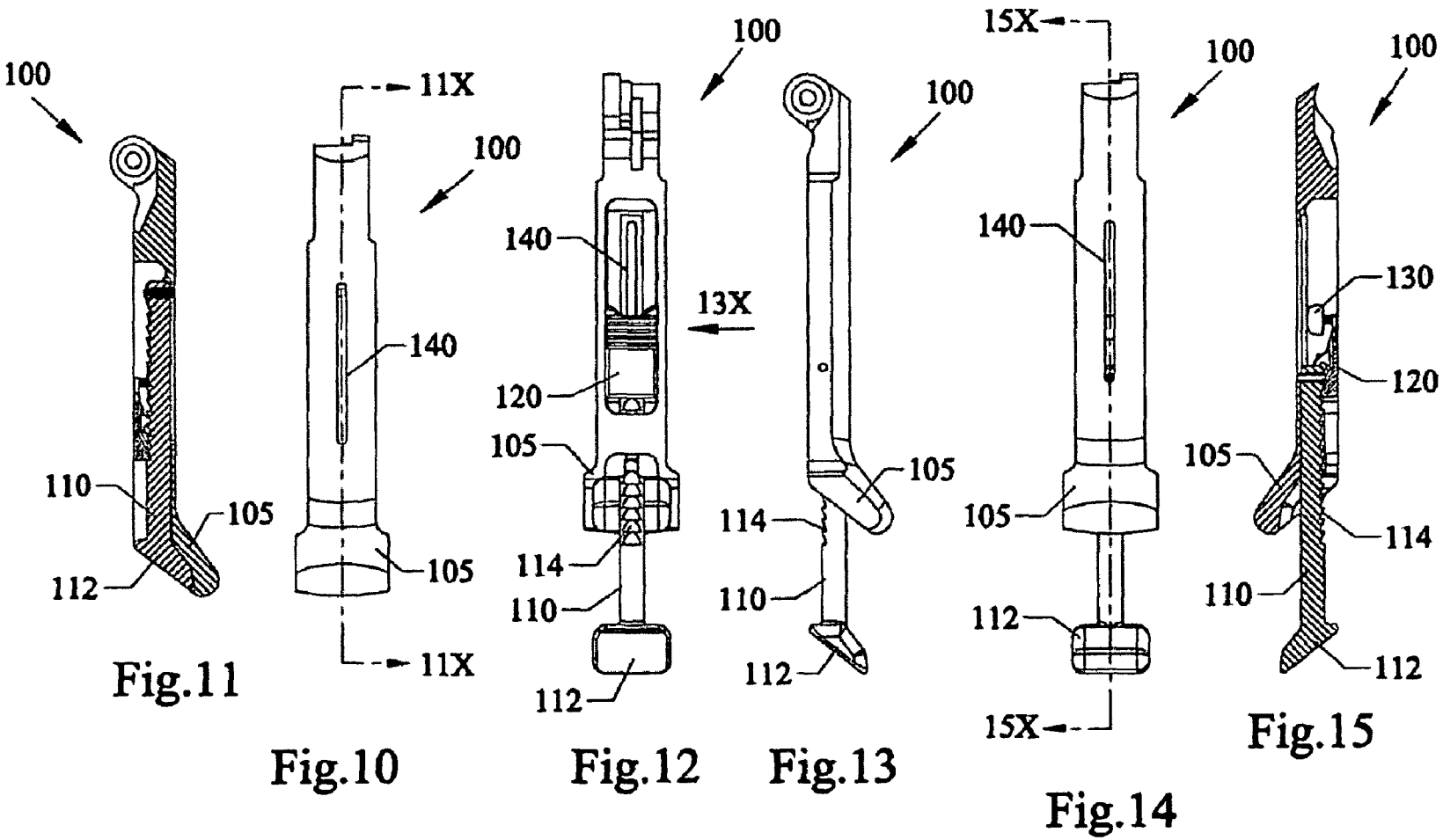
FIG. 10 is a front view of the single leg of FIG. 4 with inner leg in contracted position.
FIG. 11 is a side cross-sectional view of the single leg of FIG. 10 along arrows 11X.
FIG. 12 is a rear view of the single leg of FIG. 10 with inner leg further extended.
FIG. 13 is a side view of the further extended leg of FIG. 12 along arrow 13X.
FIG. 14 is a front view of the further extended leg of FIG. 12.
FIG. 15 is a side cross-sectional view of FIG. 14 along arrow 15X.

FIG. 10 is a front view of the single leg 100 of FIG. 4 with inner leg 110 in contracted position. FIG. 11 is a side cross-sectional view of the single leg 100 of FIG. 10 along arrows 11X. FIG. 12 is a rear view of the single leg 100 of FIG. 10 with inner leg 110 further extended. FIG. 13 is a side view of the further extended inner leg 110 of FIG. 12 along arrow 13X. FIG. 14 is a front view of the further extended inner leg 110 of FIG. 12. FIG. 15 is a side cross-sectional view of FIG. 14 along arrow 15X.

FIGS. 1-15 show each of the legs 100, 200 can have telescoping portions with feet 105, 205. The inner legs 110, 210 can telescope in and out of a hollow portions of main extendable legs 100, 200. The user can slide each leg to the same heights or different heights as terrain and weapon surface placement conditions demand.

Each of the legs 100, 200 can include telescoping inner legs 110, 210 to allow adjustment of the leg lengths for uneven terrain. Each of the legs 100, 200 can include integral molded angled outer feet 105, 205 formed with a hollow backside that mateably cover bottom angled feet portions 112, 212 of the inner extendable legs 110, 210.

Referring to FIGS. 1-15, the operator can depress roughened/raised edge surface tabs 122, 222 of the depressible buttons 120, 220 and against the spring piston latch stop(s) 130 behind the respective tabs. Each button 120, 220 can then pivot about their respective pivot pin portion 125 so that bottom catch edge 128 of the buttons 120, 220 lift out of a step groove of respective rows of step grooves 114 on inner leg 110. The operator can then stick part of their finger into one or both of finger access slots 160, 260 on rear sides of the main legs 100, 200 which allows the operator to push against a raised inner edge of bottom angled feet 112, 212 of the inner extendable legs.

While the button is depressed, the operator can pull one or both of the inner legs 110, 210 downward to desired extended positions. The operator can release the button to lock the bottom catch edge(s) 128 of the tables 120, 220 back into a selected single step groove row 114. The desired extended positions can allow the operator to level or tilt the bipod to selected orientations for firing the firearm weapon supported by the bipod.

The inner legs 110, 210 can each extend up to approximately 1½ inches to more than approximately 3 inches, in increments of approximately ⅛ of an inch. The actuator lever button 120, 220 needs to be pressed in order to retract the legs.

Extending from the inner legs 110, 210 through the front of the main legs 100, 200 can be anti-rotation pin(s) 116 which pass through longitudinal slot(s) 140 in the front of the main legs 100, 200. The anti-rotation pin(s) 116 which are fixably attached to each inner leg 110, 210 prevent the inner legs 110, 210 from rotating relative to main leg housings 100, 200.

Although the pins are shown as attached to the inner legs and the slots are in the main legs 100, 200, the pins can be fixably attached to the main legs and the inner legs can have longitudinal slots. Here, with the pins and slots reversed the inner legs are still prevented from rotating relative to the main legs 100, 200 as well.

The inner legs 110, 210 can be individually and separately extended to different lengths. Alternatively, both inner legs 110, 210 can be extended together.

The lever latch buttons 120, 220 can be spring loaded. The bottom of the latch can have an angled edge 128, which snaps into the individual grooved edges 114 of the extendable rod portion of the inner legs 110, 210. Pulling the inner legs 110, 210 downward can allow for the rod member portion to ratchet to different lengths by the depressible lever switch buttons 120, 220.

The extendable rod portions of the inner legs 110, 210 can have an optional spring(s) 150, 250 to allow for easy retraction back into the main legs 100, 200 when needed. The spring(s) 150, 250 can attach to upper ends of the inner legs 110 and an upper portion of the inside of the hollow housings of main legs 100, 200 and can be biased to move to a compressed state which allows the inner legs 110, 210 to easily retract back into their respective main leg housings 100, 200.

Alternatively, the springs 160, 260 can be biased to expand which allows the inner legs 110, 210 to extend out quickly when the respective latch buttons 120, 220 are depressed.

Figure 16:
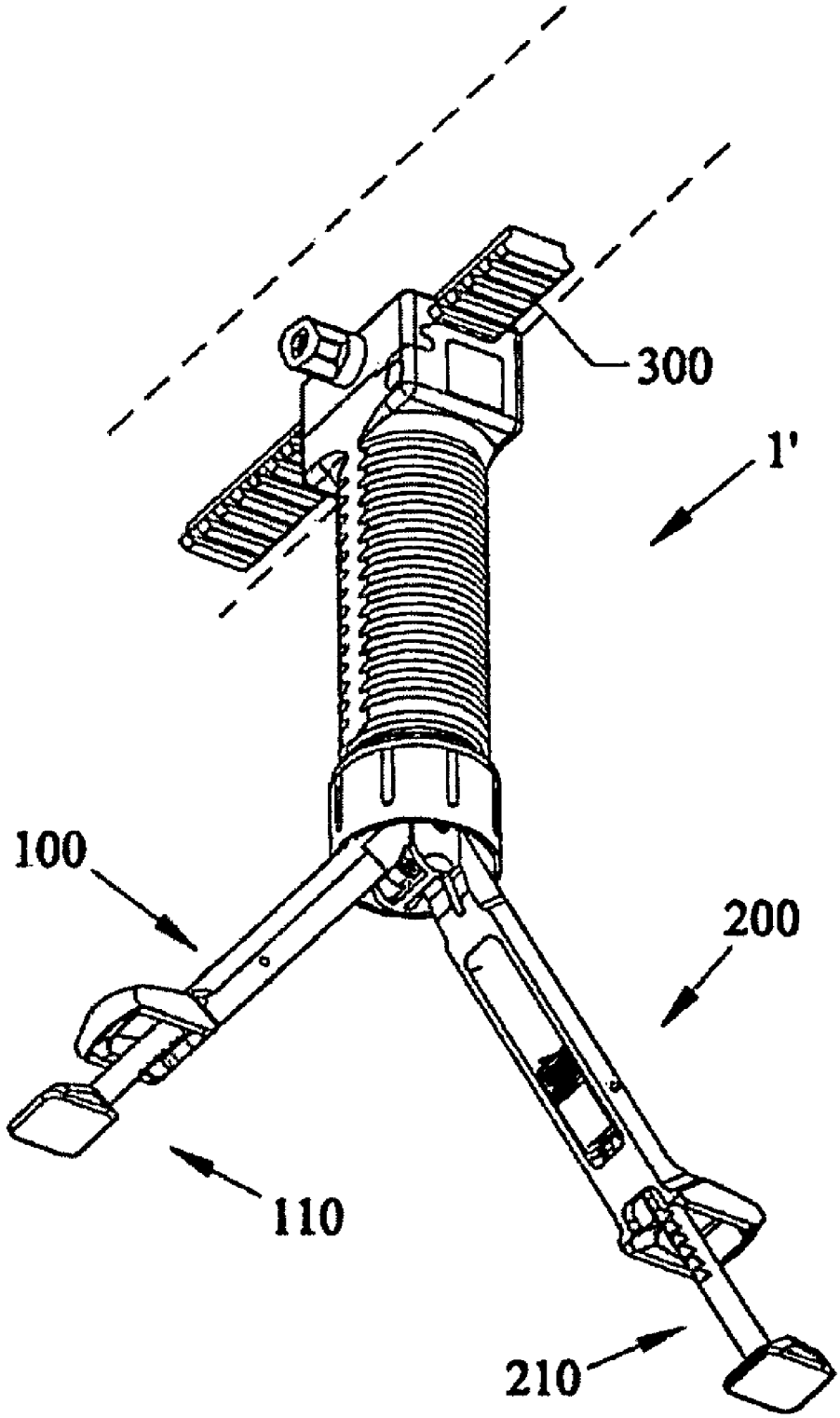
FIG. 16 is another lower perspective of the fore grip of FIG. 9 with both expanded legs further extended attached to the bottom of a firearm.

FIG. 16 is another lower perspective of the fore grip 1' of FIG. 9 with both expanded inner legs 110, 210 further extended from the main legs 100, 200 with the fore grip 1' attached to the bottom of a firearm 300.

While the embodiments describe the invention for use with extendable leg bipods, the invention can be used with any type of bipod or tripod supports for firearms.

Although the preferred embodiments describe extendable inner legs 110, 210 extend downward by being hand pulled. The inner legs can also extend outward by gravity and the like, when the latch switches 120, 220 are actuated.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A firearm fore grip with extendable legs, comprising:

an elongated handle with a generally elongated cylindrical housing, having a top end and a bottom end, the top end having a mount for attaching the upper end to a firearm having picatinny rails underneath the firearm, the mount having a pair of parallel rail clamps with a longitudinal space therebetween, the rail clamps for clamping to portions of the picatinny rails under the firearm;

a pair of legs, each of the legs having an upper end and a bottom end, each of the legs having a longitudinal axis;

an activation switch on the cylindrical housing which when activated causes the pair of legs to move from a retracted position with the legs substantially within the cylindrical housing, to release to an expansion position where substantially much of the legs protrude out beneath the cylindrical housing; and each of the legs is independently adjustable in length to different height positions, wherein the elongated handle being used as a fore grip that is adaptable to be gripped by a user when the pair of the legs are in the retracted position, and wherein the legs form a bipod when the legs are in the expansion position.

2. The fore grip of claim 1, wherein the legs include:

an access slot for allowing a user to grip a portion of the elongated rod members in order to extend the legs to the different extendable positions.

3. The fore grip of claim 1, wherein the elongated rod members include:

stepped grooves along an outer side of the elongated rod members.

4. The fore grip of claim 1, further comprising:

a depressible member for locking each of the legs to different extendable positions.

5. The fore grip of claim 1, further comprising:

pins extending from the rod members through the legs for preventing the rod members from rotating relative to the legs.

6. The fore grip of claim 5, further comprising:

longitudinal slots in the legs for allowing the pins from the rod members to slide therethrough, wherein the pins and the longitudinal slots are for preventing the rod members from rotating relative to the legs.

7. The fore grip of claim 1, wherein the rod members include angled foot portions which fit within angled foot portions on each of the legs.

8. The fore grip of claim 1, further comprising:

angled foot portions on the bottom end of each of the legs, wherein the angled foot portions extend out from underneath a bottom of the elongated cylindrical housing.

9. A bipod support stand for firearms with extendable legs comprising:

an elongated cylindrical housing adaptable for being used as a fore grip for a firearm, the housing having an upper mount for attaching underneath the firearm, the housing having a bottom end with an opening therethrough;

a pair of telescoping legs having upper ends and lower ends, the pair of legs having a retracted position that substantially fits inside of the housing, wherein the legs in the retracted position allows the housing to be used as the fore grip for the firearm, the legs having an extended position that forms an angled bipod legs configuration that are adaptable to support the firearm over a ground surface, wherein the telescoping legs are individually height adjusted over different support surfaces, wherein each of the bipod legs include:

telescoping members; and an access slot for allowing a user to grip a portion of the telescoping members in order to extend the telescoping members to the different lengths.

10. The bipod support stand of claim 9, wherein the telescoping members each include:

stepped grooves along an outer side.

11. The bipod support stand of claim 10, further comprising:

a switch for locking the telescoping members in selected stepped grooves in different extendable positions.

12. The bipod support stand of claim 9, further comprising:

pins extending from the telescoping members through the legs for preventing rod members from rotating relative to the legs.

13. The bipod support stand of claim 12, further comprising:

longitudinal slots in the legs for allowing the pins from the telescoping members to slide therethrough, wherein the pins and the longitudinal slots are for preventing the telescoping members from rotating relative to the legs.

14. The bipod support stand of claim 9, wherein each of the legs include angled foot portions on the lower ends of each of the legs, wherein the angled foot portions extend out from underneath a bottom of the elongated cylindrical housing.

15. The bipod support stand of claim 9, wherein the upper mount on the elongated cylindrical housing includes:

a pair of parallel rail clamps with a longitudinal space therebetween, the rail clamps for clamping to portions of picatinny rails under the firearm.

16. The bipod support stand of claim 9, further comprising:

an activation switch on the cylindrical housing which when activated causes the pair of legs to move from a retracted position with the legs substantially within the cylindrical housing, to release to an expansion position where substantially much of the legs protrude out beneath the cylindrical housing.

17. A firearm fore grip with extendable legs, comprising:

an elongated handle with a generally elongated cylindrical housing, having a top end and a bottom end, the top end having a mount for attaching the upper end to a firearm having picatinny rails underneath the firearm, the mount having a pair of parallel rail clamps with a longitudinal space therebetween, the rail clamps for clamping to portions of the picatinny rails under the firearm;

a pair of legs, each of the legs having an upper end and a bottom end, each of the legs having a longitudinal axis, an activation switch on the cylindrical housing which when activated causes the pair of legs to move from a retracted position with the legs substantially within the cylindrical housing, to release to an expansion position where substantially much of the legs protrude out beneath the cylindrical housing; and each of the legs which is adjustably extended to different height positions, wherein the elongated handle being used as a fore grip that is adaptable to be gripped by a user when the pair of the legs are in the retracted position, and wherein the legs form a bipod when the legs are in the expansion position; and a depressible member for locking each of the legs to different extendable positions.

18. A bipod support stand for firearms with extendable legs comprising:

an elongated cylindrical housing adaptable for being used as a fore grip for a firearm, the housing having an upper mount for attaching underneath the firearm, the housing having a bottom end with an opening therethrough;

a pair of telescoping legs having upper ends and lower ends, the pair of legs having a retracted position that substantially fits inside of the housing, wherein the legs in the retracted position allows the housing to be used as the fore grip for the firearm, the legs having an extended position that forms an angled bipod legs configuration that are adaptable to support the firearm over aground surface, wherein the telescoping legs are individually height adjusted over different support surfaces; and a pair of activation switches, each of the switches for allowing each of the telescoping legs to be individually height adjusted.

19. A bipod support stand for firearms with extendable legs comprising:

an elongated cylindrical housing adaptable for being used as a fore grip for a firearm, the housing having an upper mount for attaching underneath the firearm, the housing having a bottom end with an opening therethrough;

a pair of telescoping legs having upper ends and lower ends, the pair of legs having a retracted position that substantially fits inside of the housing, wherein the legs in the retracted position allows the housing to be used as the fore grip for the firearm, the legs having an extended position that forms an angled bipod legs configuration that are adaptable to support the firearm over a ground surface, wherein the telescoping legs are individually height adjusted over different support surfaces;

a bipod spring for spreading the legs from being substantially parallel to one another into the bipod legs configuration;

a first leg spring for extending a first leg of the pair of the telescoping legs to be individually height adjusted; and a second leg spring for extending a second leg of the pair of the telescoping legs to be individually height adjusted.

20. A bipod support stand for firearms with extendable legs comprising:

an elongated cylindrical housing adaptable for being used as a fore grip for a firearm, the housing having an upper mount for attaching underneath the firearm, the housing having a bottom end with an opening therethrough;

a pair of telescoping legs having upper ends and lower ends, the pair of legs having a retracted position that substantially fits inside of the housing, wherein the legs in the retracted position allows the housing to be used as the fore grip for the firearm, the legs having an extended position that forms an angled biped legs configuration that are adaptable to support the firearm over a ground surface, wherein the telescoping legs are individually height adjusted over different support surfaces; and a pair of activation switches, each of the switches for allowing each of the legs to be individually height adjusted.

21. A bipod support stand for firearms with extendable legs comprising:

an elongated cylindrical housing adaptable for being used as a fore grip for a firearm, the housing having an upper mount for attaching underneath the firearm, the housing having a bottom end with an opening therethrough;

a pair of telescoping legs having upper ends and lower ends, the pair of legs having a retracted position that substantially fits inside of the housing, wherein the legs in the retracted position allows the housing to be used as the fore grip for the firearm, the legs having an extended position that forms an angled bipod legs configuration that are adaptable to support the firearm over a ground surface, wherein the telescoping legs are individually height adjusted over different support surfaces;

a bipod spring for spreading the legs from being substantially parallel to one another into the bipod;

a first leg spring for extending one of the legs to different height positions; and a second leg spring for extending another of the legs to different height positions.

* * * * *